United States Patent [19]

Hagelberg

[11] 3,984,167

[45] Oct. 5, 1976

[54] IMPROVEMENT IN ELECTRICAL UNITS FOR CONNECTING TO A CABLE

[75] Inventor: Torvald S. Hagelberg, Molnlycke, Sweden

[73] Assignee: Bengt Petersson New Products Investment AB, Goteborg, Sweden

[22] Filed: June 10, 1974

[21] Appl. No.: 477,933

[30] Foreign Application Priority Data

June 13, 1973 Sweden ..... 7308286

[52] U.S. Cl. ..... 339/99 R

[51] Int. Cl.[2] ..... H01R 13/38

[58] Field of Search ..... 339/95, 97–99, 339/103

[56] References Cited

UNITED STATES PATENTS

| | | | |
|---|---|---|---|
| 2,647,245 | 7/1953 | Gilbert | 339/99 R |
| 2,745,077 | 5/1956 | Cook | 339/99 R |
| 2,810,894 | 10/1957 | Kerr | 339/99 R |
| 2,866,170 | 12/1958 | Baldridge | 339/99 R |
| 3,274,531 | 9/1966 | Bourhenne | 339/99 R |
| 3,437,981 | 4/1969 | Keller | 339/103 R |

FOREIGN PATENTS OR APPLICATIONS

| | | | |
|---|---|---|---|
| 502,922 | 7/1930 | Germany | 339/103 R |
| 383,458 | 1/1965 | Switzerland | 339/99 R |
| 1,021,989 | 3/1966 | United Kingdom | 339/103 M |

*Primary Examiner*—Joseph H. McGlynn
*Attorney, Agent, or Firm*—Toren, McGeady and Stanger

[57] ABSTRACT

The invention relates to means by which electrical units as plugs and lamp-sockets are provided to be connected to a multi conductor cable. Such means are arranged to separate the conductors and connect them to the connection points of the unit thereby penetrating the insulation of the conductors and providing contact between contact points and the core of the conductors.

3 Claims, 12 Drawing Figures

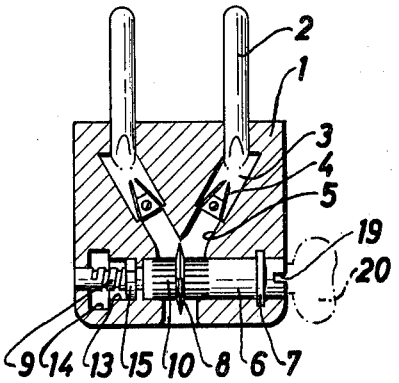
FIG. 1
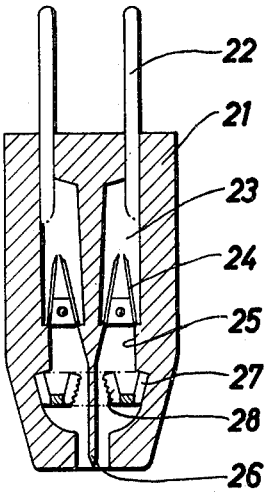
FIG. 5
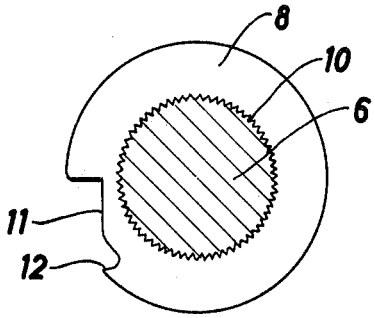
FIG. 2
FIG.4
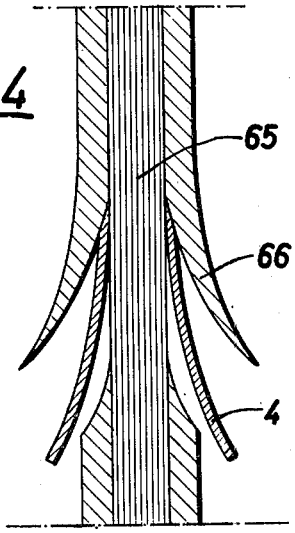
FIG.3
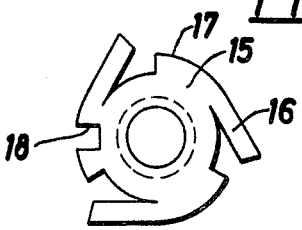

IMPROVEMENT IN ELECTRICAL UNITS FOR CONNECTING TO A CABLE

The present invention relates to electrical units provided to be connected to a cable, comprising a number of insulated conductors, such as for plugs and lamp-sockets and provided with a number of connection means. Electrical conductors of a cable, after having been stripped of their insulation, are connected to electrical units such as plugs, lamp sockets and flex switches by some form of clamping means. There are also certain exceptions especially in low-voltage engineering, where the connection is made by soldering or by spot welding the cable leads to the contact points of the electrical unit.

In the case of the first mentioned type of connection, there is the disadvantage that the task of connection is complicated; in addition to stripping the cable, the clamping screw joint (of a relatively complex design) must be tightened with several screw joints and parts fitted together. The second type of connection mentioned has the disadvantage of having to be carried out by means of hand operations or industrial methods and is thus unsuited for general use in normal households.

The object of the invention is to provide a device for electrical units to be connected to a cable that will make the task of connecting extremely fast and easy, thereby eliminating any possibility of error.

Another object of the invention is to achieve an electrical unit of this type which is simple in design and with few parts, enabling it to be manufactured at low cost by line production methods.

The purpose of the invention is provided in that the unit comprises means arranged to displace the insulated conductors away from each other and to connect them to respective connection means. The latter are arranged with cutting organs for piercing the insulation of the conductor and for being pressed against the core of the conductor.

In the accompanying drawings are shown three different embodiments of the invention described below.

FIG. 1 shows a sectional plug;

FIGS. 2 – 3 show details of the plug in FIG. 1 on an enlarged scale;

FIG. 2 is a cross section of a rod and ring of the plug; FIG. 3 is a cross section of a nut used in said plug;

FIG. 4 is a cross-sectional view view showing plug contact with a cable in accordance with the present invention;

FIG. 5 shows a sectioned low-voltage plug;

Figure 6:
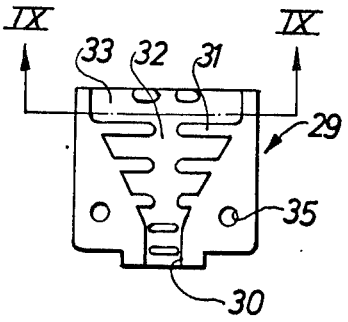
Figure 7:
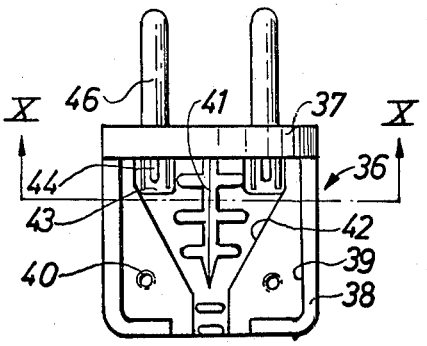
Figure 8:
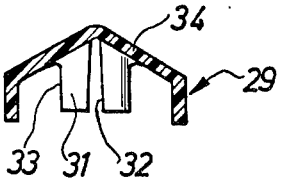
Figure 9:
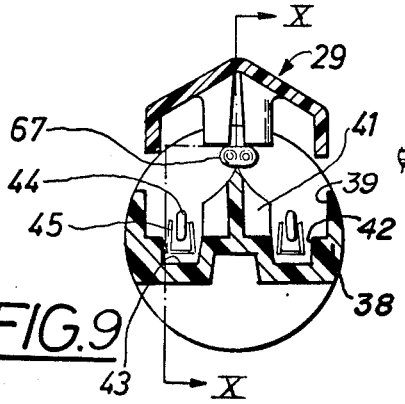
Figure 10:
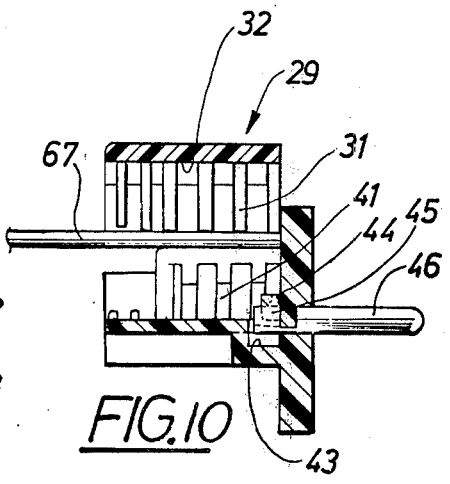
Figure 11:
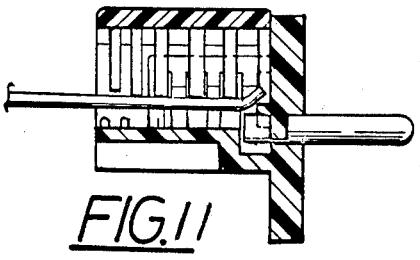
Figure 12:
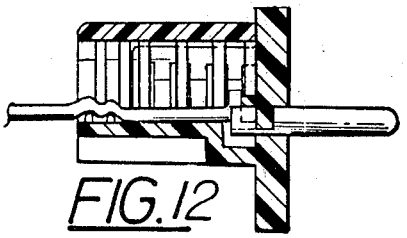

FIGS. 6 – 12 show a third design, also a plug, with FIG. 6 showing a first part of the plug in elevation, FIG. 7 a second part in elevation, FIG. 8 the first part in sectional elevation along the line VIII — VIII in FIG. 6, FIG. 9 showing the parts in sectional elevation along the line VIII VIII in FIG. 1 and the line IX — IX in FIG. 7, in a first moment of an operation in which the two housing parts are put together. FIGS. 10 – 12 show the two parts in sectional elevation along the lines X — X in different moments of said operation with the operation ended in FIG. 12.

In FIG. 1, a plug comprises an insulator body 1 with two contact pins 2 embedded, each terminated with an inner plate 3, on which a spring contact clip 4, forming the connection means, is rivetted. From an end surface of the insulator body 1 and up to the two plates 3 runs a Y-shaped branching channel 5. Across this channel 5 runs a rotary mounted rod 6 with an axial guide 7, a knife-shaped ring 8 and a thread 9. On both sides of the ring 8, the rod 6 is equipped with a fluting 10 and the ring 8 has a notch 11 (as shown in FIG. 12), which terminates at the edge-like periphery of the ring in a projecting point 12. The thread 9 is encircled by a circular space with a smaller and a larger diameter 13 and 14 respectively. On the thread 9, there is a nut 15 (see FIG. 3) with resilient wings 16 for attaining the locked position shown in FIG. 3, but which can be pressed in to follow the periphery 17 of the nut. The nut 15 is provided with a keygroove 18, for which there is corresponding protrusion arranged but not shown in the space 13, 14.

For rotating the rod 6, there is a screw driver slot 19, but the rod can also be provided with a disconnectable hand grip 20.

In the operation of attaching the plug, the rod 6 assumes the position shown in FIG. 1; the nut 15 is thus screwed to clockwise and the notch 11 faces outwards towards the outer opening of the channel 5. The intended cable, which typically has two conductors surrounded by an insulating cover and is equipped with a weakened section between the leads, is introduced into the channel 5 as far as the notch 11 in the ring 8 allows. Then the rod 6 is turned so that the fluting 10 begins to feed in the cable which is kept pressed against the rod by an upper wall in the channel 5. During the rotation, the point 12 is forced up between the conductors cable and parts its cover, this separation continuing by means of the edged ring 8 as the cable is fed in. During the rotation, the nut 15 moves in the space 13, 14 and when the nut has reached the opposite wall in the space, the rod 6 cannot be turned any more.

In this position, the cable parted by the ring 8 has with each of its two parts continued into the two branches of the channel respectively and the ends have passed the clips 4 while being resiliently squeezed by them. When the rod 6 has been turned to the terminal position described it is reversed. Thereby the clips 4 pinch the insulation round the parts of the cable by means of their spring action and cut through it into the core, as shown in FIG. 4, where the core itself is marked 65 and the surrounding insulation 66. Reversing is only possible a limited way as the nut is locked in the larger space 14 (compare FIG. 3) and cannot pass its inner (right) wall bounding spaces 13 and 14. In this final position, the cable parts are still between the clips 4, and the clips have penetrated with their edges into the core 19 of the cable parts. The unit is now connected. The rod 6 in this state prevents the cable to be drawn out.

The plug in the embodiment as shown in FIG. 5 also has an insulating cover 21, two contact pins 22 with flat-shaped parts 23, on which clips 24 are attached and in the cover 21, two channels 25. The channels are separated by a tongue with an outer, terminating point 26 and, in a conical section of the channels a bridge 27 running into both channels, is fixed by means of yielding cogged sections 28.

Fitting is done by pushing in the cable with the conductor containing outer sections on either side of the point 26, thereby causing separation. The two sections of the cable continue past the bridge 27, section 28 and on through the clips 24 to the ends of the channels 25. Whereupon the cable is pulled outwards, thereby stripping it by means of the clips 24 in the same way as described previously. When pulling out the cable, the bridge 27 follows with it while the grip on the sections 28 increases as a result of the conical nature in the position for the bridge 27. This pinching round the cable and the limited ability of the bridge 27 to move makes it only possible to pull out the cable a limited way, so that its leads are still retained in the clips 24. This design is primarily intended for cables with conductors of solid-drawn metal wire.

The embodiment in the FIGS. 6 – 12 concerns a connection plug which consists of two housing parts, viz., a first part being an insulator body 29 as in FIG. 6 with a hollow space 30, in which a number of extending projecting portions 31 are arranged. The portions 31 are broken off in the middle, thus forming a slot 32, and there are two spaces 33 formed on the outermost portions. The bottom 34 of the part 29 is, as shown in FIG. 8, roof-shaped. In part 29 there are also two holes 35.

The second part 36 of the plug, shown in FIG. 7, is designed as an insulator body with a plate 37 and a section 38 projecting from it in which there is a recess 39, the contour of which fits the part 29. Two thread holes 40 correspond to the holes 35 and a system of projecting portions 41 like a Christmas tree (compare FIG. 8), having branch elements 49, is arranged to correspond to the spaces between the portions 31 including the slot 32. In the recess 39, a second recess 42 is arranged with two hollows 43. Above the hollows 43 are arranged narrow projecting elements 44 and clips 45, connected to the contact pins 46 of the plug. The two halves of the plug are pressed together with screws in the holes 35, 40.

When fitting, a cable is laid straight into the recess 30 in the part 28, whereupon the part 36 is pressed down into it. The system of elements 41 with the pointed center elements will then divide the cable into its two parts, each containing a conductor, and push these parts to the sides so that the ends are in the center across the hollows 43. When the parts 29, 36 are further squeezed together, as in FIG. 12, the element 44 presses down the end section of the lead 67 of the conductor into the recess 43, whereupon the clip 45 is pushed down around the bent down end of the conductor and strips it and pinches it around its core in a similar way to that described in connection with the previously explained designs. In this way, the clip 45 gains contact with the core in the section 67 of the conductor, thereby connecting these to the contact pin 46.

The invention is in the foregoing shown and described only in the connection with embodiments relating to male plug units. However, the invention is directed towards the connection means which facilitates the connection of the unit to a cable and these connection means are possible to be combined with several types of electric units. As described, male plugs are typical but also female plugs, lamp-holders, switches and jointing units for cables are encompassed. To apply the invention to the different types of electric units will be obvious to everyone skilled in the art and is therefore not described here.

I claim:

1. An electrical unit for being connected to a cable having a number of insulated conductors comprising:

first and second separate housing portions, said housing portions for receiving a cable and for being consolidated by compression into a single unit;

electrical connection means disposed in one of said housing portions and arranged apart from each other and having cutting elements for piercing the insulation of a conductor and for making electrical contact with said conductors;

means disposed in said housing portions, for splitting an end of the cable into separated, insulated conductors and for displacing said conductors to respective ones of said electrical connection means to which they are to be connected, said splitting and separating means including two parts, one of said parts being disposed in said first housing portion and including an edge-shaped element for separating the cable, said edge-shaped element being a part of a row of projections having a wedge-shaped cross-section and being pointed in the direction required to compress the housing portions into a single unit, the second part of said splitting and separating means being disposed in said second housing portion and including a second row of projections, said second row of projections in said second housing portion being arranged to interfit with said first row of projections in said first housing portion when said two housing portions are compressed, said second portion adapted to receive a cable opposite to said edge-shaped element so that when a cable end is inserted in said second housing portion and the two housing portions are compressed together, the end of the cable is split into separate insulated conductors, the separated conductors being further separated by the pointed projections in said first housing portion and still further separated, under continued compression, by the mutually interfitting rows of projections; and means to guide said separated conductors to respective positions adjacent the connection means wherein further compression of said two housing portions will cause said connection means to pierce the insulation of said separated conductors and establish electrical contact with said conductors.

2. The electrical unit of claim 1 wherein said second row of projections in said second housing portion includes a central opening in the center of all of the projections, an end projection of said second row of projections having a pair of openings positioned at either side of the projection, said cable being positioned along the central openings of the projections and said two side openings are adapted for guiding the separated conductors of the cable.

3. The electrical unit of claim 2 wherein said first row has a central supporting element bearing said edge-shaped element, said row of projections extending from said supporting element in a tree-like manner.

* * * * *